US006942495B2

(12) United States Patent
Liao et al.

(10) Patent No.: US 6,942,495 B2
(45) Date of Patent: Sep. 13, 2005

(54) ELECTRICAL CONTACT WITH INTERFERENTIAL PROTRUDING PORTIONS

(75) Inventors: Fang-Jwu Liao, Tu-Chen (TW); Fu-Jin Peng, Shenzhen (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/853,373

(22) Filed: May 24, 2004

(65) Prior Publication Data

US 2004/0235316 A1 Nov. 25, 2004

(30) Foreign Application Priority Data

May 23, 2003 (TW) ..... 92209569 U

(51) Int. Cl.[7] ..... H01R 12/00
(52) U.S. Cl. ..... 439/66; 439/733.1; 439/71
(58) Field of Search ..... 439/66, 733.1, 439/71

(56) References Cited

U.S. PATENT DOCUMENTS 5,984,693 A * 11/1999 McHugh et al. ..... 439/66
5,997,315 A * 12/1999 Akama et al. ..... 439/66
6,234,839 B1 * 5/2001 Zhang ..... 439/595
6,261,132 B1 * 7/2001 Koseki et al. ..... 439/733.1
6,296,495 B1 * 10/2001 Wang et al. ..... 439/71
6,447,339 B1 9/2002 Reed et al.
6,488,513 B1 * 12/2002 Neidich et al. ..... 439/66
6,585,527 B2 * 7/2003 Koopman et al. ..... 439/71
6,733,303 B2 * 5/2004 Maldonado et al. ..... 439/66
6,749,440 B1 * 6/2004 Szu et al. ..... 439/66
6,749,441 B1 * 6/2004 Ma ..... 439/66
6,843,659 B2 1/2005 Liao et al.

OTHER PUBLICATIONS

"Agilent Technologies Soft Touch Connectorless Probes"—User's Guide, Agilent Technologies, Inc. 2002–2004, 78 Pages.

"Tektronix TMS817 and TMS818 PCIExpress Buss Supports 071–1214–00"—Instruction Manual, Copyright Tektronix, Inc., 65 Pages.

* cited by examiner

*Primary Examiner*—Gary Paumen
(74) *Attorney, Agent, or Firm*—Wei Te Chung

(57) ABSTRACT

A contact (1) used in an electrical connector (3) appears C-like shape and includes a first arm (10) connecting to an IC module (4), a second arm (12) connecting to a PCB (5), and a medial portion (14) connecting therebetween. The medial portion defines two symmetrical fastening blocks (141) on both sides thereof. In addition, the fastening block defines a plurality of protruding portions (1412) extending along a direction perpendicular to a main surface on which the fastening block locates. Accordingly, the contact is fastened in the connector firmly and reliably.

3 Claims, 5 Drawing Sheets

ELECTRICAL CONTACT WITH INTERFERENTIAL PROTRUDING PORTIONS

BACKGROUND OF THE INVENTION

1. Field of the Invention

The present invention relates to the art of electrical contact used in an electrical connector for electrically connecting an integrated circuit (IC) module to a printed circuit board (PCB).

2. Description of the Prior Art

Land grid array (LGA) connectors are widely used in personal computer (PC) systems to electrically connect LGA chips with PCBs. An LGA connector comprises a multiplicity of contacts arranged in a rectangular array. Each contact has a first contact portion soldered to a PCB, and a second contact portion depressed by and engaging with a corresponding contact pad of an LGA chip. Thus the chip and the PCB are electrically connected by the connector.

China Patent Nos. ZL95223360.6 and ZL0221158.3, and U.S. Pat. Nos. 6,296,495 and 5,984,693 each disclose a conventional contact of an LGA electrical connector. Referring to FIG. 8, U.S. Pat. No. 6,296,495 discloses a contact 5 of an LGA electrical connector. The contact 5 is stamped from a resilient metal strip. The contact 5 comprises a horizontal soldering base 50, for soldering the contact 5 to a circuit pad of a PCB (not shown) and thereby electrically connecting the contact 5 with the PCB. The soldering base 50 has a rear end 501 and a front end 503. An upper spring arm 52 extends upwardly and forwardly from a rear end 501 of the soldering base 50. The spring arm 52 has a curved top contact portion 521 for engaging with a plate-like contact pad of an LGA chip (not shown) when the LGA chip is pressed against the LGA electrical connector. Thus, the contact 5 electrically connects the LGA chip with the PCB. A lower beam 54 upwardly and forwardly extends from a front end 503 of the soldering base 50. A vertically oriented junction portion 56 extends from a front end of the lower beam 54. An upper section of the junction portion 56 is bifurcated, and forms a pair of retention arms 561. The lower contact beam 54 and the junction portion 56 are integrally joined between the retention arms 561. A multiplicity of barbs 562 is respectively formed on opposite vertical side edges of the junction portion 56, for interferentially fixing the contact 5 in an insulative housing (not shown).

However, the barbs 562 are so thin that the contact 5 is liable to sustain deformation in assembly of the LGA electrical connector. In addition, the horns of the barbs 562 are prone to scrape inner surfaces of a corresponding passageway of a housing (not shown) of the LGA electrical connector, resulting in the contact 5 not being securely fastened in the passageway. These contingencies can lead to failure of electrical connection between the LGA chip and PCB.

Hence, a new LGA electrical connector contact is required to overcome the above-described disadvantages.

SUMMARY OF THE INVENTION

An object of the present invention is to provide a contact having a highly reliable fastening structure.

Another object of the present invention is to provide an LGA electrical connector having contacts firmly and reliably fastened therein.

In order to achieve the aforementioned objects, a contact in accordance with a preferred embodiment of the present invention used in an electrical connector appears C-like shape and comprises a first arm connecting to an IC module, a second arm connecting to a PCB, and a medial portion connecting therebetween. The medial portion defines two symmetrical fastening blocks on both sides thereof. In addition, the fastening block defines a plurality of protruding portions extending along a direction perpendicular to a main surface on which the fastening block locates. Accordingly, the contact is fastened in the connector firmly and reliably.

Other objects, advantages and novel features of the present invention will become more apparent from the following detailed description when taken in conjuction with the accompanying drawings, in which:

DESCRIPTION OF THE PREFERRED EMBODIMENT

Figure 1:
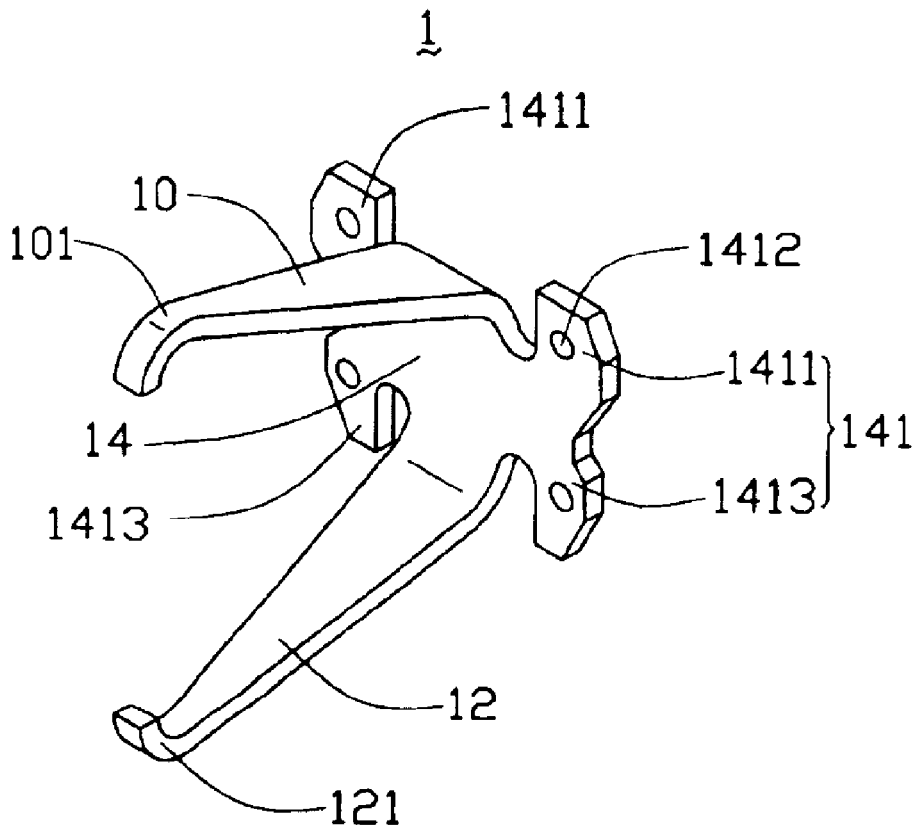
FIG. 1 is an isometric view of a contact for an electrical connector in once with the preferred embodiment of the present invention.

Reference will now be made to the drawing figures to describe the present invention in detail.

Figure 2:
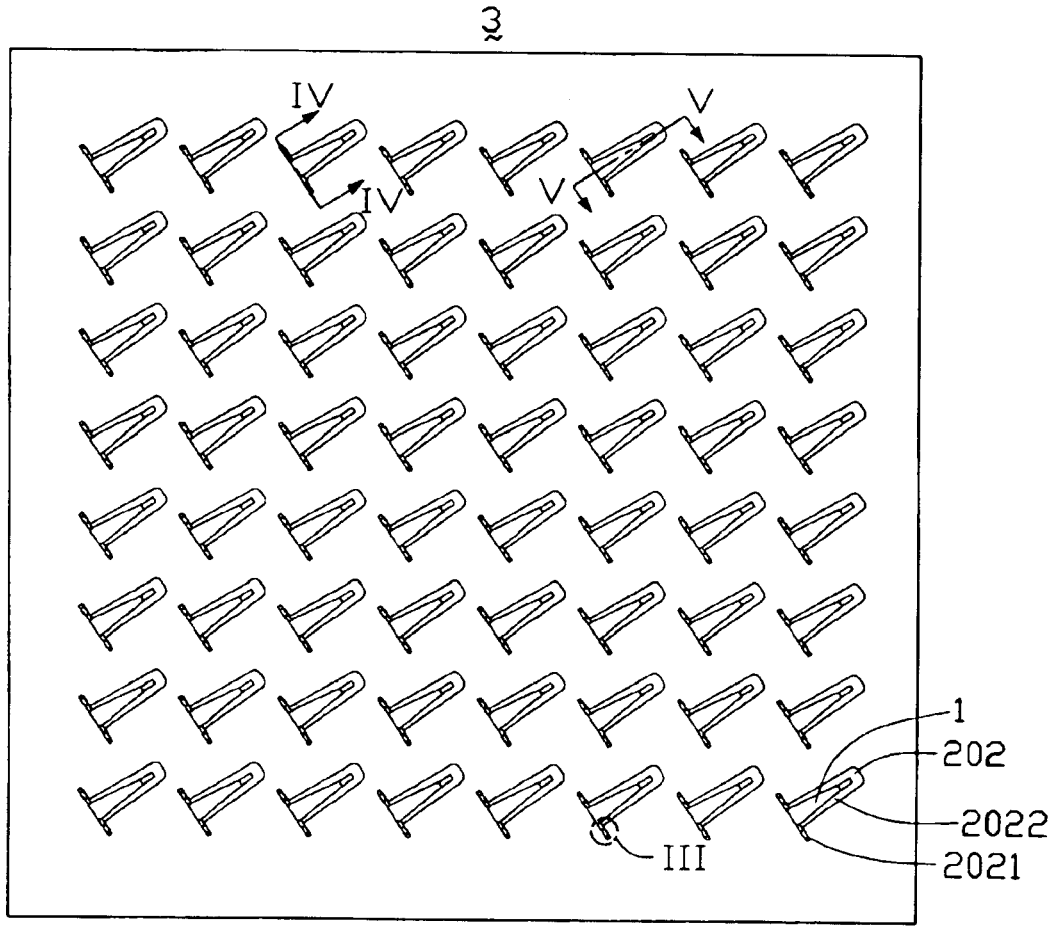
FIG. 2 is a top plan view of a multiplicity of the contacts as per the contact of FIG. 1 received in a housing of the electrical connector.
Figure 3:
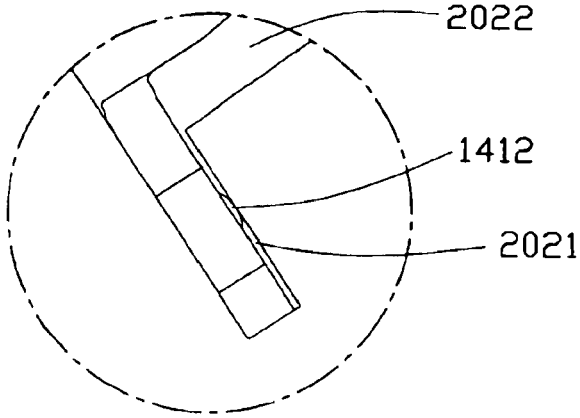
FIG. 3 is an enlarged view of a circled portion III of FIG. 2.
Figure 7:
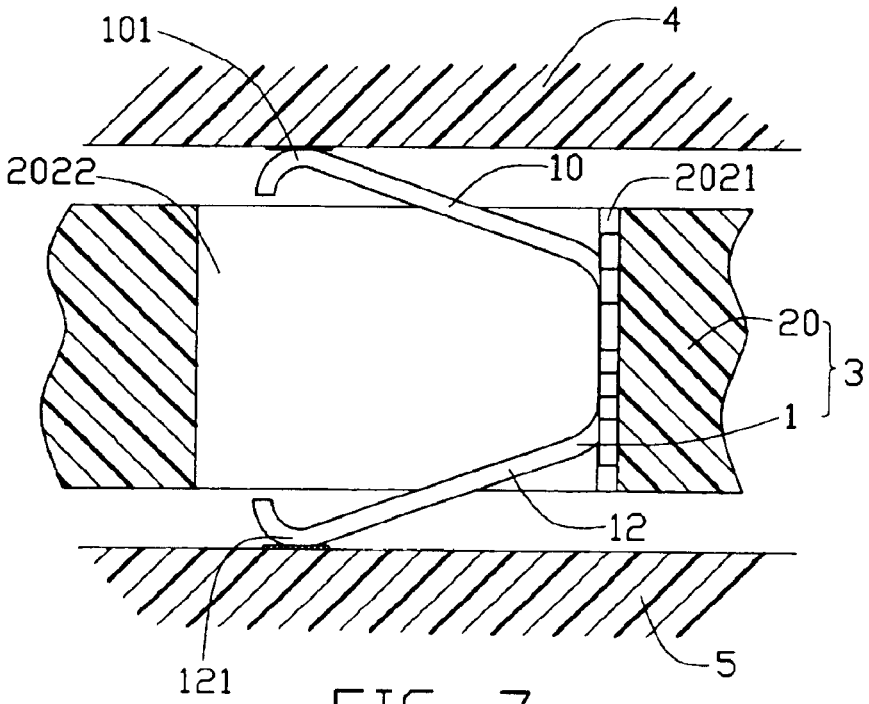
FIG. 7 is similar to FIG. 5, but also showing the contact of the electrical connector connecting to corresponding parts of an IC module and a PCB.
Figure 8:
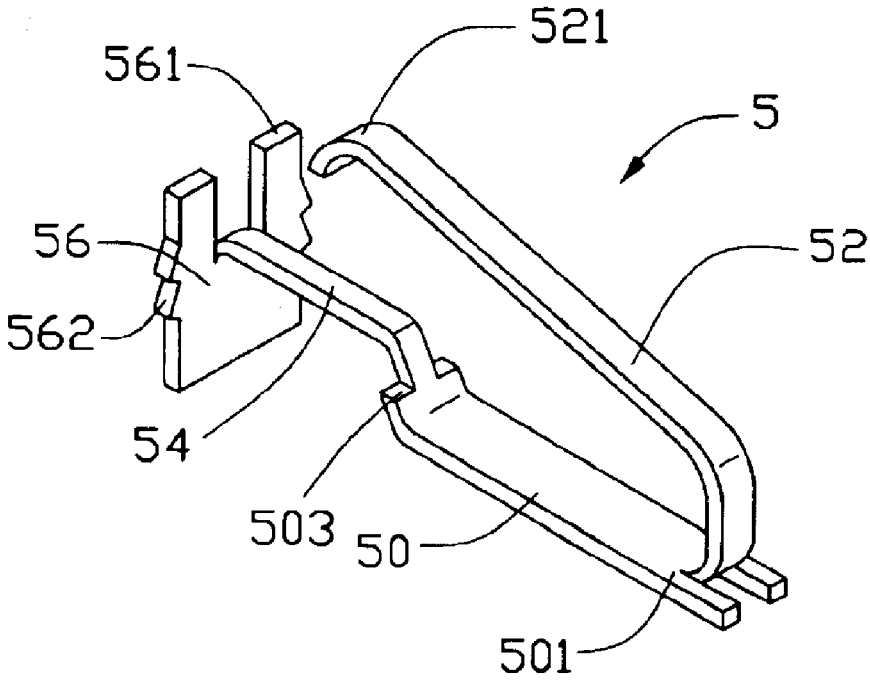
FIG. 8 (PRIOR ART)
FIG. 8 is an isometric view of a conventional contact of an electrical connector.

Referring to FIGS. 1–3, an electrical contact 1 in accordance with the preferred embodiment of the present invention is used in an electrical connector 3 that electrically connects an IC module 4 and a PCB 5 (see FIG. 7). The contact 1 comprises a first arm 10 defining a first contacting portion 101 at a distal end thereof, a second arm 12 defining a second contacting portion 121 at a distal end thereof, and a medial portion 14 interconnecting the first and second arms 10, 12. The medial portion 14 comprises a pair of coplanar fastening blocks 141 at each of opposite sides thereof respectively. The first arm 10 and the second arm 12 extend from upper and lower sides of the medial portion 14 respectively, whereby the contact 1 is generally C-shaped. Each fastening block 141 comprises an upper block 1411 adjacent the first arm 10, and a lower block 1413 adjacent the second arm 12. A horizontal width of the upper block 1411 is greater than that of the lower block 1413. A protruding portion 1412 is formed on a main face of each of the upper and lower blocks 1141. Each protruding portion 1412 is dome-shaped.

An insulative housing 20 of the electrical connector 3 defines a multiplicity of passageways 202 therein, which are adapted to receive a multiplicity of the contacts 1 therein. Each passageway 202 has a generally T-shaped profile. Each passageway 202 comprises a fastening slot 2021 cooperating with the fastening blocks 141, and a receiving slot 2022 adapted to receive the first and second arms 10, 12 therein. The receiving slot 2022 is in communication with the fastening slot 2021.

Figure 4:
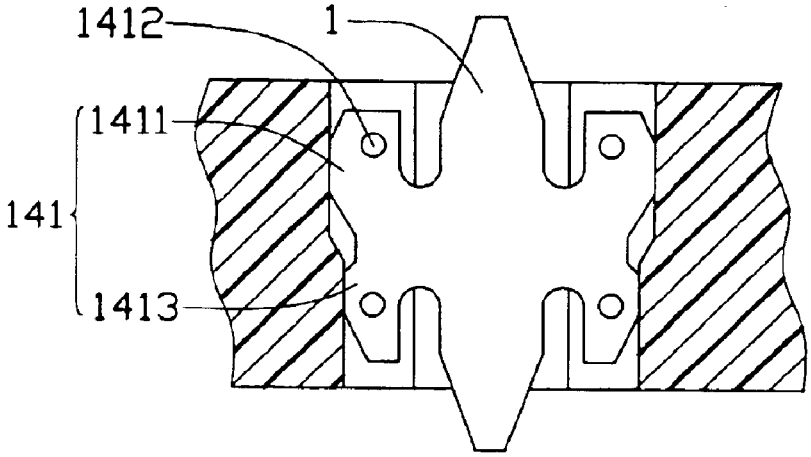
FIG. 4 is a cross-sectional view taken along line IV—IV of FIG. 2.
Figure 5:
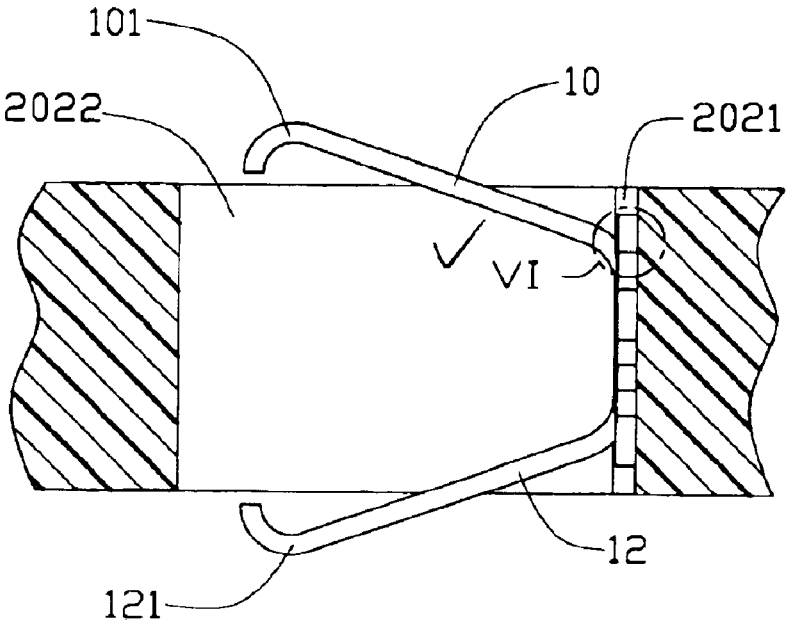
FIG. 5 is a cross-sectional view taken along line V—V of FIG. 2.
Figure 6:
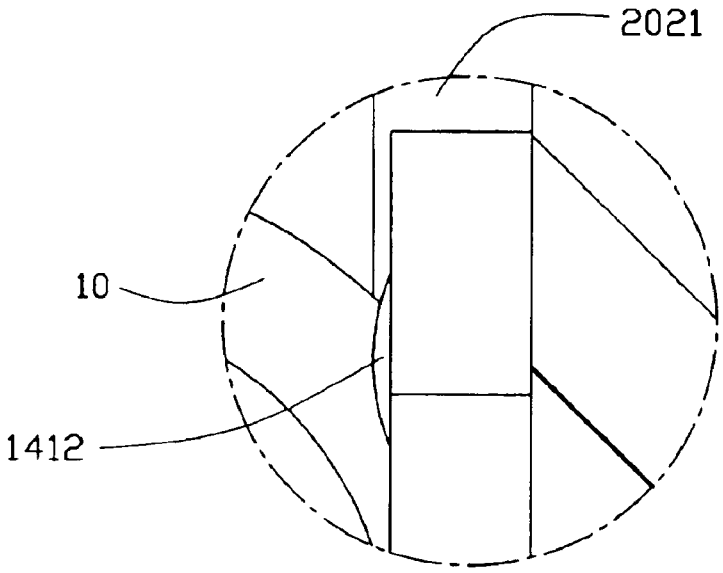
FIG. 6 is an enlarged view of a circled portion VI of FIG. 5.

Referring to FIGS. 4–6, when each contact 1 is installed in a corresponding passageway 202, the medial portion 14 is positioned in the fastening slot 2021, the first and the second arms 10, 12 are received in the receiving slot 2022. The fastening blocks 141 are thus interferentially received in the fastening slot 2021, because of the interference between the protruding portions 1412 and corresponding sidewalls of the housing 20 that bound the fastening slot 2021.

Referring to FIG. 7, when the contact 1 is completely installed in the passageway 202, the first arm 10 and the second arm 12 partially protrude out from top and bottom faces respectively of the housing 20. When the connector 3 is used, the first contacting portion 101 of the first arm 10 elastically and electrically connects with a corresponding conductive portion of the IC module 4, and the second contacting portion 121 of the second arm 12 elastically and electrically connects with a corresponding conductive portion of the PCB 5. Accordingly, the IC module 4 is electrically connected to the PCB 5 securely and reliably.

While the present invention has been described with reference to a specific embodiment, the description is illustrative of the invention and is not to be construed as limiting the invention. Various modifications to the present invention can be made to the preferred embodiment by those skilled in the art without departing from the true scope and spirit of the invention as defined by the appended claims.

What is claimed is:

1. An electrical contact in an electrical connector electrically connecting an integrated circuit (IC) module to a printed circuit board (PCB), the contact comprising:

a first arm electrically connected to the IC module;

a second arm electrically connected to the PCB; and a medial portion interconnecting the first and second arms, the medial portion comprising at least one fastening block defining a main surface; wherein a plurality of protruding portion extends from the main surface of the at least one fastening block;

wherein the first arm defines a first contacting portion at a distal end thereof;

wherein the second arm defines a second contacting portion at a distal end thereof;

wherein the at least one fastening block is coplanar with the medial portion;

wherein each of the protruding portions is generally dome-shaped.

2. An electrical connector for electrically connecting an integrated circuit module to a printed circuit board, the electrical connector comprising:

an insulative housing defining a plurality of passageways, each of the passageways comprising a fastening slot and a receiving slot in communication with the fastening slot;

a plurality of contacts received in the passageways, each of the contacts comprising a first arm, a second arm and a medial portion interconnecting the first and second arms; wherein the medial portion comprises at least one fastening block, the at least one fastening block having a plurality of protruding portions extending from a main surface thereof;

wherein the medial portion of the contact is interferentially received in the fastening slot of a corresponding passageway;

wherein the first arm defines a first contacting portion at a distal end thereof wherein the second arm defines a second contacting portion at a distal end thereof;

wherein the at least one fastening block is coplanar with the medial portion of the contact;

wherein each of the protruding portions is generally dome-shaped.

3. An electrical connector comprising:

an insulative housing defining a plurality of passageways vertically extending therethrough;

each of said passageways defining a T-shaped cross-sectional configuration including a narrow fastening slot and a wide receiving slot perpendicular to each other;

a plurality of contacts disposed in the corresponding passageways, respectively, each of said contacts including:

a medial portion positioned in the fastening slot;

upper and lower arms extending from upper and lower ends of the medial portion; and a pair of fastening blocks respectively formed by two sides of the medial portion; wherein each of said fastening blocks includes not only a barb structure extending laterally in a coplanar manner with the medial portion and interfering with the housing, but also a dome-shaped protruding portion extending in a direction perpendicular to a main face of said medial portion to be engaged within the corresponding fastening slot in said direction so that the fastening block can efficiently hold the contact in the passageway;

wherein there are two fastening blocks on each side of the medial portion, and said two fastening blocks are laterally dimensioned differently from each other in compliance with different lateral structures in the corresponding fastening slot;

wherein one of said two fastening blocks is smaller than the other, and said contact is inserted into the corresponding passageway in a direction along which said one fastening block is inserted into the corresponding fastening slot before said other fastening block.

* * * * *